US009076616B2

(12) United States Patent
Oebser

(10) Patent No.: US 9,076,616 B2
(45) Date of Patent: Jul. 7, 2015

(54) METHODS AND APPARATUS FOR IMPROVED LATCHING RELAY DRIVER

(71) Applicant: Raritan, Inc., Somerset, NJ (US)

(72) Inventor: Stefan Oebser, Zwickau (DE)

(73) Assignee: RARITAN INC., Somerset, NJ (US)

( * ) Notice: Subject to any disclaimer, the term of this patent is extended or adjusted under 35 U.S.C. 154(b) by 45 days.

(21) Appl. No.: 13/754,252

(22) Filed: Jan. 30, 2013

(65) Prior Publication Data

US 2014/0211363 A1 Jul. 31, 2014

(51) Int. Cl.
*H01H 47/00* (2006.01)
*H01H 47/32* (2006.01)

(52) U.S. Cl.
CPC ..... *H01H 47/32* (2013.01)

(58) Field of Classification Search
CPC ..... F16P 3/20
USPC ..... 361/190
See application file for complete search history.

(56) References Cited

U.S. PATENT DOCUMENTS 3,728,608 A * 4/1973 Teich ..... 320/146
6,126,141 A * 10/2000 Geiger ..... 251/129.01
8,668,279 B2 * 3/2014 Van Deventer ..... 303/3

* cited by examiner

*Primary Examiner* — Stephen W Jackson
(74) *Attorney, Agent, or Firm* — Vorys, Sater, Seymour and Pease LLP; Vincent M DeLuca

(57) ABSTRACT

Methods and apparatus provide for at least one relay with contacts transitioning from: an OFF state to an ON state in response to an ON-pulse of current through a coil in a first direction; and the ON state to the OFF state in response to an OFF-pulse of current through the coil in a second, opposite direction. A driver circuit operates to produce the ON-pulse through the coil of the relay in response to a control signal commanding the ON-state of the contacts; produce the OFF-pulse of current through the coil of the relay in response to a control signal commanding the OFF-state of the contacts; and produce the OFF-pulse of current through the coil of the relay in response to a loss of operating potential across the pair of operating power nodes.

12 Claims, 3 Drawing Sheets

METHODS AND APPARATUS FOR IMPROVED LATCHING RELAY DRIVER

BACKGROUND

The invention relates to methods and apparatus for controlling the delivery of power to a load, and more particularly relates to power control techniques that improve reliability and reduce power consumption.

Information technology (IT) equipment rooms (also known as data centers) utilize hundreds or even thousands of units of IT equipment. Each piece of IT equipment receives primary power by plugging into an outlet of a power distribution unit ("PDU"). A PDU is also a piece of IT equipment and typically includes: (a) a high power inlet from which power is received (typically from a panel board); (b) multiple lower power outlets; and (c) (optional) circuit breakers or fuses to protect the outlets from over current conditions (short circuits, etc.). PDUs are often designed to report certain status information over a communication and/or input/output interface, including: (a) the voltage being supplied to a given PDU's inlet, (b) how much power is flowing in the inlet and each outlet, and (c) the trip state (whether voltage is present) of each circuit breaker.

Additionally, each PDU may include the capability of turning the output voltage on and off in response to microcontroller signaling. This capability permits some level of software control over the power being delivered from each output of the PDU to much, if not most, of the of the IT equipment. The capability of turning the output voltage on and off may also provide a means of preventing rather significant in-rush currents to flow when main power is lost and then recovered. Indeed, when main power is first provided to a PDU (after having been lost of intentionally turned off), it is desirable to ensure that the output voltage to most if not all of the IT equipment connected to that PDU is off. If the output voltage were not initially off, then a very large in-rush of current to the IT equipment would occur, possibly tripping one or more circuit breakers protecting the PDU. However, assuming that the output voltage to individual pieces of IT equipment (or reasonably sized groups thereof) may be individually turned on in sequence, the aggregate current supplied by the PDU to the all IT equipment may be controlled and gradually ramped up.

FIG. 1A illustrates a block diagram of a conventional system 10 for controlling a single output of a PDU. The system 10 includes a microcontroller 12, an electromechanical relay 14, and a driver circuit 16. The microcontroller 12 is capable of producing a signal on a general-purpose-input-output (GPIO) pin that controls the state of the output voltage (e.g., 120V AC) delivered to the output of the PDU, labeled AC LOAD. The AC LOAD represents whatever IT equipment (not shown) is connected to the PDU. For brevity and clarity, this description will not go into extensive detail as to the hardware, firmware, and/or software functionality of the microcontroller 12. Suffice it to say that there are numerous conditions under which it is desirable for the microcontroller 12 to turn ON, turn OFF, and FLOAT the signal on the GPIO pin. It is noted that while there may be tens, hundreds, or thousands of GPIO pins in the system 10, the description here is concerned with one such pin, which description may be extended to other GPIO pins in the system 10.

In general, the state of the GPIO pin provides a control signal to the driver circuit 16, which in turn controls the state of the relay 14, thereby either connecting or disconnecting the output voltage (e.g., 120 VAC) to the AC LOAD.

The electromechanical relay 14 includes a coil and at least one set of contacts. It is assumed that the relay 14 is "normally open," which means that when the coil is not energized (no current, iC, is flowing through the coil), the contacts assume an OFF (open) state and the current path between the set of contacts is open. In the OFF state, there is no current path from the 120V AC node to the AC LOAD. When the coil is energized, where current, iC, is flowing through the coil, a magnetic field produced by the coil causes the contacts to pull in and assume an ON state, where the current path between the set of contacts is closed. In the ON state, there is a current path from the 120V AC node to the AC LOAD, thereby energizing the load.

If a standard relay 14 is employed, then the driver 16 would have to provide the current iC to the coil of the relay 14 in order to keep the normally-open contacts closed. The level of power utilized to maintain the normal relay 14 in the ON state is typically 0.4 watts. In a data center containing 2000 PDUs, where each PDU contains 24 relays, the power consumption to maintain the relays in the ON state would be 19,200 watts. Although normally closed relays are available, there are fail safe problems with their use and they too would consume excessive power in order to keep them OFF for any long period of time. This is very undesirable.

There are, however, ways to reduce the total power consumed for maintaining relays in the ON and/or OFF state, which result in a direct financial benefit for the data center operator and a competitive advantage for the PDU manufacturer. In particular, one may employ a so-called latching relay 14 in the system 10 instead of a normal relay. The latching relay 14 only uses power briefly to latch the contact state to ON or OFF. Once latched ON or OFF, no further power is required to maintain the commanded state. A detailed discussion of the system 10 employing a latching relay 14 is given below.

With further reference to FIG. 1B, the GPIO pin exhibits a tri-state output, where the state of the GPIO pin may be OFF (e.g., 0 volts), ON (e.g., 1 volt), or FLOAT (e.g., a high impedance). When the GPIO pin is OFF, the potential is at a logic low (e.g., 0 volts) and the pin is capable of sinking current (into a relatively low impedance). When the GPIO pin is ON, the potential is at a logic high (e.g., 1 volt) and the pin is capable of sourcing current (from a relatively low impedance). When the GPIO pin is at the FLOAT state, the pin operates as a relatively high impedance input, and assumes a potential dictated by the circuitry external to the microcontroller 12.

The driver 16 controls the current iC through the coil of the relay 14 in response to the potential on the GPIO pin. In the illustrated example, between time=0 and t1, it is assumed that the GPIO pin is in the FLOAT state, there is no current through the coil of the relay 14, the contacts of the relay are open, and there is no voltage delivered to the AC LOAD. Between time t1 and t2, the command to provide voltage to the AC LOAD is given and the GPIO pin provides an ON potential of about 1 volt to the driver circuit 16, which in turn produces a positive pulse of current iC (X=33 mA) to the coil of the relay 14. The pulse of current iC through the coil causes the contacts to be pulled in and latched ON, thereby providing output voltage to the AC LOAD, even after time t2 (when the pulse is gone). Between time t3 and t4, the command to remove voltage to the AC LOAD is given and the GPIO pin provides an OFF potential of about 0 volts, pulsed of otherwise, to the driver circuit 16, which in turn sinks a pulse of current iC (−X=−33 mA) from the coil of the relay 14. The negative pulse of current iC through the coil causes the contacts to be latched OFF, thereby providing no output voltage to the AC LOAD (see potential A), even after time t4 (when the pulse is gone).

The above latching relay implementation of the system 10 overcomes the excessive power consumption problem discussed above. In addition, under certain conditions, the system 10 may be used to address the problem of in-rush current because the timing of turning ON the individual relays may be controlled by the microcontroller 12. However, under other conditions, the system 10 may not address the problem of in-rush current. Indeed, referring again to FIG. 1B, the system 10 may deliver output voltage to all the loads of the PDU by sequentially turning on the relays 14, by pulsing the respective coils, such pulse for a single such coil being shown from time t5 to t6. Thereafter, at time t7, main power may be lost. The loss of power, however, does not result in any of the relays 14 being turned OFF because they are latching relays, which would remain in the latched ON state. Meanwhile, power to all of the IT equipment would reduce to zero and such equipment would sit idle until power is again applied. At time t8, the main power may be restored, which would result in the output voltage (see potential B) being immediately and simultaneously applied to all of the AC LOADs, and a large in-rush current through all of the relays 14 to the AC LOADs, which is clearly an undesirable result.

Thus, although the prior art systems address some inherent disadvantages of the conventional PDU systems, the known solutions are unsatisfactory in the context of both the aforementioned undesirable power dissipation inefficiencies and in-rush current conditions. There are, therefore, needs in the art for new methods and apparatus for controlling the power delivery to the load, which address the efficiency issue and the in-rush current issue.

SUMMARY OF THE INVENTION

Methods and apparatus provide for: at least one electromechanical, latching relay including a coil and at least one pair of contacts, the contacts transitioning from: (i) an OFF, disconnected state to an ON, connected state in response to an ON-pulse of current through the coil in a first direction; and (ii) the ON state to the OFF state in response to an OFF-pulse of current through the coil in a second, opposite direction; and a driver circuit having at least one control signal input node, at least one pair of coil current output nodes, and at least one pair of operating power nodes.

The driver circuit operates to: (i) produce the ON-pulse of current between the at least one pair of coil current output nodes and through the coil of the relay in response to a control signal commanding the ON-state of the contacts; (ii) produce the OFF-pulse of current between the at least one pair of coil current output nodes and through the coil of the relay in response to a control signal commanding the OFF-state of the contacts; and (iii) produce the OFF-pulse of current between the at least one pair of coil current output nodes and through the coil of the relay in response to a loss of operating potential across the pair of operating power nodes.

Other aspects, features, and advantages of the present invention will be apparent to one skilled in the art from the description herein taken in conjunction with the accompanying drawings.

BRIEF DESCRIPTION OF THE DRAWINGS

For the purposes of illustration, there are forms shown in the drawings that are presently preferred, it being understood, however, that the invention is not limited to the precise arrangements and instrumentalities shown.

DETAILED DESCRIPTION OF PREFERRED EMBODIMENTS

Although one or more embodiments of the invention may be designed for use in a PDU intended for IT equipment applications, and is here illustrated as used in such a PDU, this is not required. Various aspects of the invention are suitable for use in any application requiring control of power to a load through a relay or set of relays.

Figure 2:
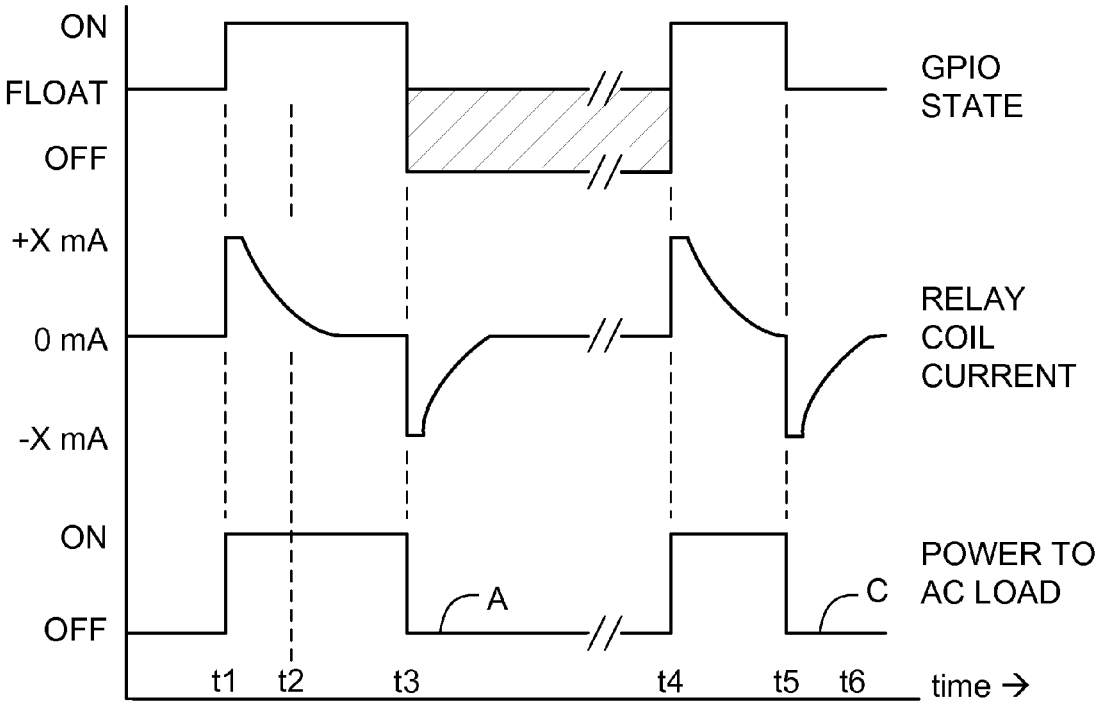
FIG. 2 is timing diagram of some of the signals within a novel control system for controlling power delivery to a load using a microcontroller and relay circuit in accordance with one or more embodiments of the present invention.
Figure 3:
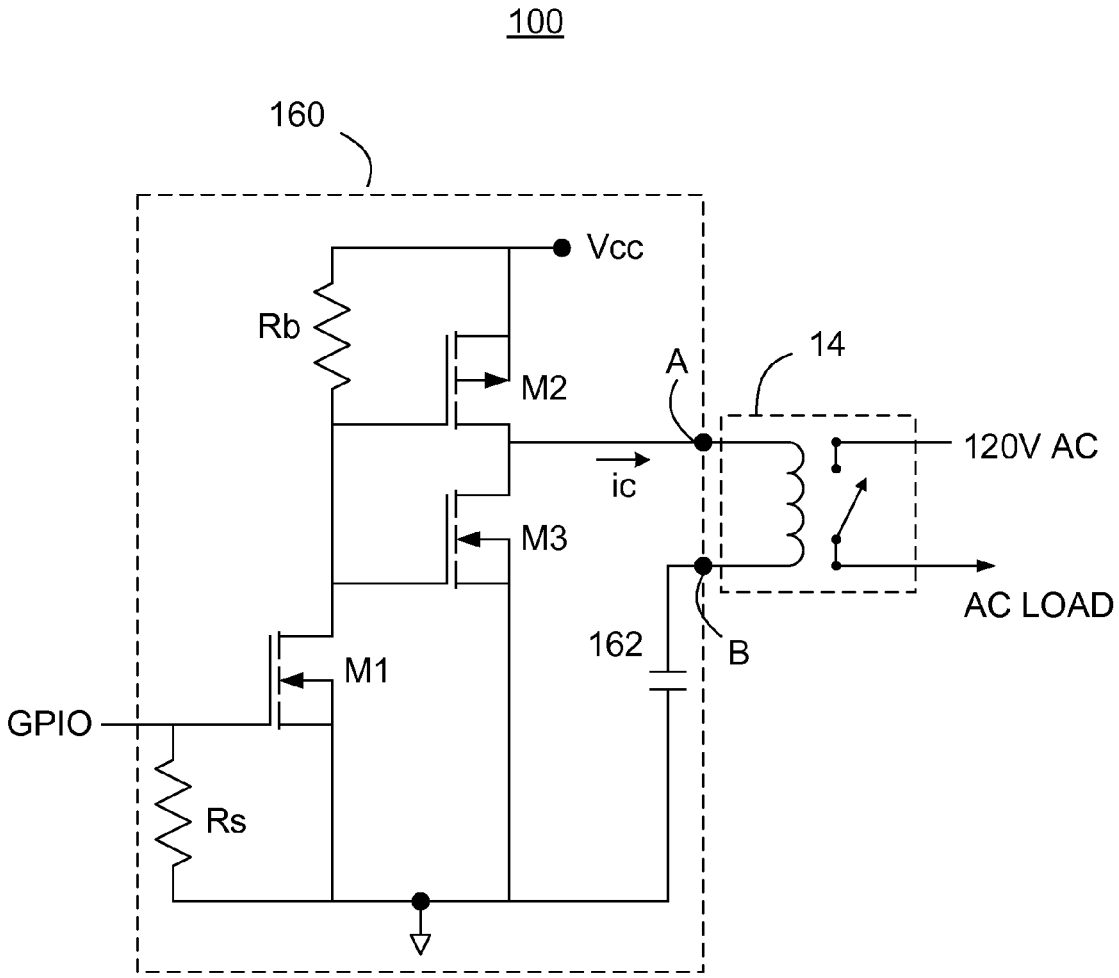
FIG. 3 is a block diagram of a driver circuit suitable for implementing a portion of the system and for producing some of the required signals of FIG. 2.

Reference is now made to FIGS. 2 and 3, the former being a timing diagram of some of signals within a novel control system 100 for controlling power delivery to a load using a microcontroller (not shown) and relay circuit 14 in accordance with one or more embodiments of the present invention, and the latter being a block diagram of a driver circuit suitable for implementing a portion of the system 100 and for producing some of the required signals of FIG. 2.

The system of FIGS. 2-3 discloses a driver circuit, the circuit 160 of FIG. 3 being but one example, which provides unique and advantageous functionality to the system 100 over prior art techniques. As noted above, the microcontroller operates to execute software/firmware instructions in order to achieve desirable operation of the relay circuit 14. More particularly, software/firmware being executed by the microcontroller may command the state of any number of GPIO pins thereof. In general, there may be N such GPIO pins on a given microcontroller. In some embodiments, there may be more than one microcontroller to increase the available number of GPIO pins.

For purposes of discussion, there are a number of characteristics and definitions relating to the GPIO pins of the microcontroller that will be referenced later in this description. By way of definition, a given GPIO pin is capable of operating as a tri-state output, where the state of the GPIO pin may be ON, OFF, or FLOAT, depending on the commands established by software/firmware being executed on the microcontroller.

The OFF state is defined as a logic "low" level, which may be any suitable voltage potential (often about 0 volts, or ground), and in such state the GPIO pin is capable of sinking current (into a relatively low impedance). The ON state is defined as a logic "high" level, which again may be any suitable voltage potential. The actual voltage of the GPIO pin in the ON state is often dictated by the operating DC supply voltage to the microcontroller 102. By way of example, such logic high voltage level may be anywhere between about 0.333 to about 5 VDC (with reference to ground), although lower and higher voltage levels are also possible. In the ON state, the GPIO pin is capable of sourcing current at the logic high voltage level (from a relatively low source impedance). The FLOAT state of the GPIO pin is defined in terms of a relatively high impedance input, which assumes a voltage potential dictated by the circuitry external to the microcontroller.

The microcontroller may be implemented utilizing any of the known technologies, such as commercially-available microprocessors, digital signal processors, any of the known processors that are operable to execute software and/or firmware programs, programmable digital devices or systems, programmable array logic devices, or any combination of the above, including devices now available and/or devices which are hereinafter developed. By way of example, the microcontroller may be implemented using the STM32 ARM MCU, which is available from a company called STMicroelectronics.

For purposes of discussion, there are also a number of characteristics relating to the relay circuit 14 that will be referenced later in this description. The relay circuit 14 is intended to be implemented by way of at least one electromechanical device, including a coil and at least one pair of contacts, where the configuration adheres to the operation of a latching relay. Thus, the least one electromechanical, latching relay 14 includes a coil and at least one pair of contacts. The contacts transition from an OFF, disconnected state to an ON, connected state in response to an ON-pulse of current through the coil in a first direction. In this example, the first direction may be assumed to be the direction of the arrow iC (FIG. 3). The contacts transition from the ON state to the OFF state in response to an OFF-pulse of current through the coil in a second, opposite direction as compared with the first direction. For purposes of example, some embodiments herein assume that the relay 14 includes normally-open contacts, which is a useful configuration for controlling the power to the AC LOAD. It is noted, however, that the invention also contemplates other embodiments wherein normally-closed contacts may be useful.

The driver circuit 160 includes at least one control signal input node, labeled GPIO in FIG. 3 as the node is intended to receive a control signal from the GPIO pin of the microcontroller. The driver circuit 160 also includes at least one pair of coil current output nodes A, B, which are connected to the respective terminals of the coil of the relay 14. The driver circuit 160 also includes at least one pair of operating power nodes, such as Vcc and ground. The voltage potential of Vcc is typically about +12 VDC and ground is typically 0 VDC; however, other suitable voltage potentials may be employed.

The driver circuit 160 operates, in conjunction with the tri-state output of the GPIO pin of the microcontroller, to control the current through the coil of the relay 14 in order to achieve desirable circuit performance. With specific reference to FIG. 3, the performance of the driver circuit 160 is characterized by one or more of the scenarios discussed below.

In the illustrated example, between time=0 and t1, it is assumed that the GPIO pin is in the FLOAT state, there is no current through the coil of the relay 14, the contacts of the relay 14 are open, and there is no power delivered to the AC LOAD.

At time t1, the microcontroller produces a control signal on the GPIO pin (e.g., about 1 volt), commanding the driver circuit 160 to negotiate the ON-state of the contacts. In response, the driver circuit 160 produces an ON-pulse of current between the pair of coil current output nodes A, B and through the coil of the relay 14 in the first direction, iC. The pulse of current iC through the coil causes the contacts to be pulled in and latched ON. The reason for the gradual decay of the ON-pulse of current will be discussed in more detail later in this description. A preferred maximum level for the ON-pulse of current is about +X=33 mA, although other levels are possible depending on the characteristics of the relay 14. Once the contacts turn ON (and close) the power is delivered to the AC LOAD. Notably, since the characteristics of the latching relay 14 maintain the contacts closed even after the ON-pulse decays to zero mA, the power continues to be delivered to the AC LOAD even at time t2 and thereafter.

At time t3, the microcontroller produces a control signal on the GPIO pin (e.g., about 0 volts), commanding the driver circuit 160 to negotiate the OFF-state of the contacts to remove power from the LOAD. In response, the driver circuit 160 produces an OFF-pulse of current between the pair of coil current output nodes A, B and through the coil of the relay 14 in the second direction, −iC. Alternatively, at time t3 the microcontroller may produce a control signal on the GPIO pin to FLOAT, which is essentially a high impedance input condition. Under that condition, the driver circuit 160 preferably also negotiates the OFF-state of the contacts to remove power from the LOAD. Indeed, in response to the OFF or FLOAT condition of the GPIO pin, the driver circuit 160 produces an OFF-pulse of current between the pair of coil current output nodes A, B and through the coil of the relay 14 in the second direction, −iC.

The OFF-pulse of current −iC through the coil causes the contacts to be released and latched OFF. Again, there is a gradual decay of the OFF-pulse of current, which will be discussed in more detail later in this description. A preferred maximum level for the OFF-pulse of current is about −X=−33 mA, although other levels are possible depending on the characteristics of the relay 14. Once the contacts turn OFF (and open) the power is removed from the AC LOAD. Notably, since the characteristics of the latching relay 14 maintain the contacts open even after the OFF-pulse decays to zero mA, the power continues to be removed from the LOAD even at times after t3.

Figure 1A:
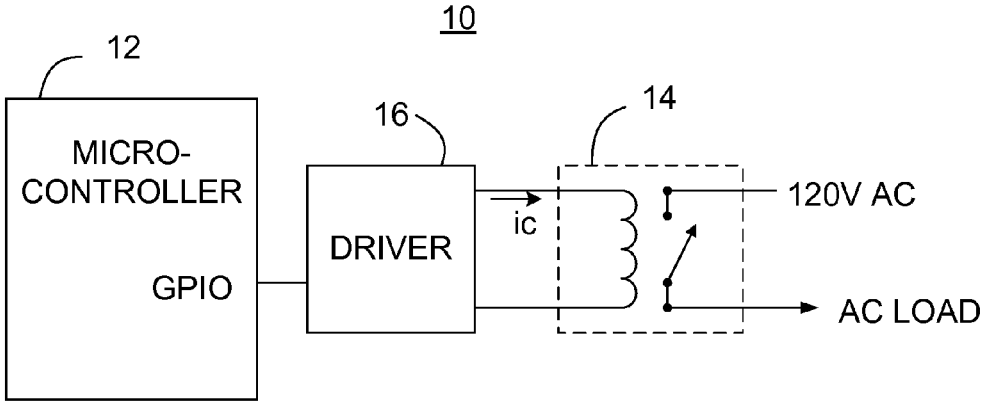
FIG. 1A (Prior Art)
FIG. 1A is a block diagram of a system for controlling power delivery to a load using a microcontroller and relay circuit in accordance with the prior art.
Figure 1B:
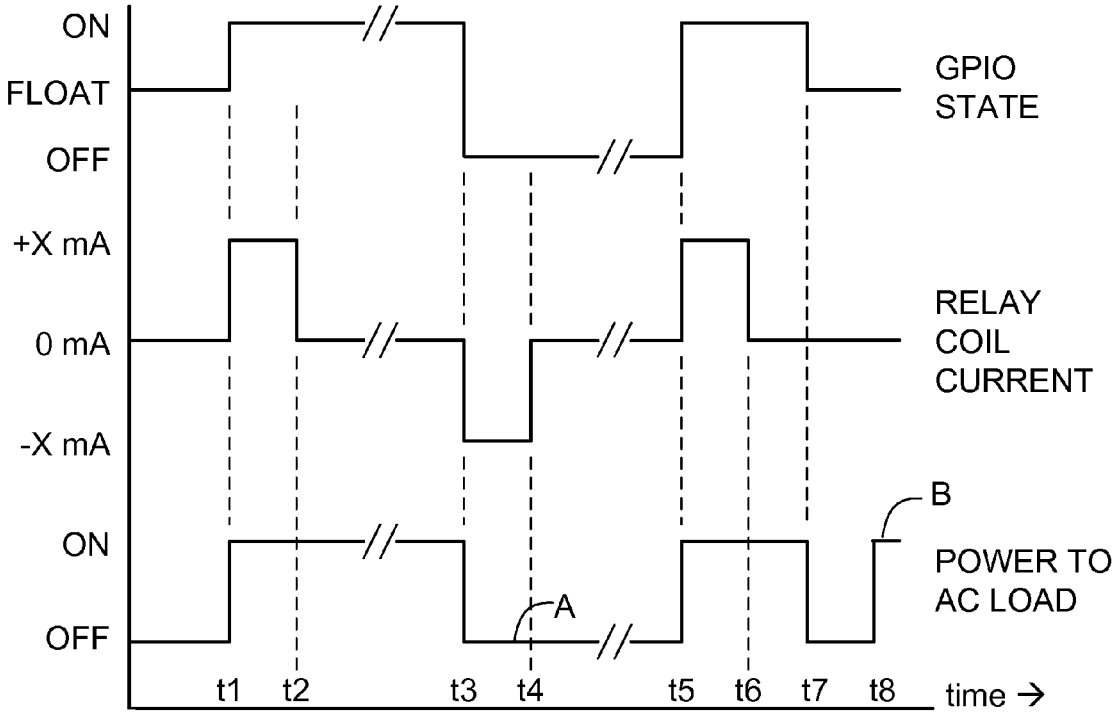
FIG. 1B (Prior Art)
FIG. 1B is timing diagram of some of the signals within the system of FIG. 1A.

As was the case with the conventional system 10 of FIGS. 1A-1B, the operation of the system 100 of FIGS. 2-3 overcomes the excessive power consumption problem because there is no hold current required for maintaining the latching relays 14 in the ON state. In addition, the system 100 may also be used to address the problem of in-rush current because the timing of turning ON the individual relays 14 may be controlled by the microcontroller. There is, however, a notable advantage in the operation of the system 100 of FIGS. 2-3 as compared to the prior art system 10. In particular, the system 100 retains the ability to control in-rush current even when there is a loss of operating power and subsequent recovery of operating power.

Indeed, referring again to FIG. 2, at time t4 the system 100 may deliver output voltage to the LOAD by commanding the driver circuit 160 to deliver an ON-pulse of current iC to the coil of the relay 14. Thereafter, at time t5 main power may be lost, which causes the control signal on the GPIO pin to FLOAT. As noted above, the FLOAT condition on the GPIO pin causes the driver circuit 160 to produce the OFF-pulse of current −iC through the coil of the relay 14 in the second direction, thereby opening the contacts of the relay 14 and removing power from the AC LOAD. Recall, however, that in the prior art system 10, such loss of power did not result in any of the relays 14 being turned OFF; indeed, the latching relays 14 remained in the latched ON state.

In accordance with the system 100, however, the driver circuit 160 produces the OFF-pulse of current −iC through the coil of the relay 14 in response to a loss of operating potential across the operating power nodes (e.g., Vcc and ground). Thus, when the main power is restored, such as at time t6, the output voltage from the relay 14 (see potential C) is at zero and no power is being delivered to the AC LOAD. Consequently, there is no in-rush current through the relay to the AC LOAD; rather, the in-rush current may be controlled through the judicious use of commanding the relay 140N at the appropriate time.

The above functional features of the system 100 may be implemented in many different ways, and all such implementations are intended to be covered by the invention. Among such implementations is the specific circuit configuration of the driver circuit 160 of the system 100 illustrated in FIG. 3.

Importantly, the driver circuit 160 includes a capacitance 162 for storing electrical charge. The capacitance 162 may be implemented using any of the known technologies, such as one or more commercially available capacitors connected in a suitable network. The capacitance 162 is coupled between the coil current output node B and one of the operating power nodes, namely ground. The driver circuit 160 also includes a switching circuit operating to source and sink current to and from the coil of the relay 14 in response to the command signal from the GPIO pin of the microcontroller.

In response to the control signal commanding the ON-state of the contacts, the switching circuit of the driver circuit 160 operates to source the ON-pulse of current iC from one of the operating power nodes (e.g., the Vcc node) through one of the coil current output nodes (e.g., node A), through the coil of the relay 14 in the first direction, and through the capacitance 162. This action causes charge to build up on the capacitance 162.

In addition, the switching circuit of the driver circuit 160 has a very different response to the control signal commanding the OFF-state of the contacts, and/or the loss of operating potential across the pair of operating power nodes (which would result in a FLOAT command signal). In particular, the switching circuit of the driver circuit 160 operates to source the OFF-pulse of current −iC from the capacitance 162 (by discharging the stored charge thereon), through the other of the coil current output nodes (e.g., node B), through the coil of the relay 14 in the second direction, and into the other of the operating power nodes (e.g., the ground node).

Although any number of implementations of the switching circuit are possible to achieve the above functionality, the illustrated example includes a complementary symmetry, push-pull switching transistor configuration, including a control node (which may be considered the node connected to the GPIO pin) and a push-pull output node (which is connected to the coil current output node A). In general, the complementary symmetry, push-pull switching transistor configuration operates to couple the push-pull output node (node A) to the Vcc node, in response to an ON potential on the control node, which corresponds to the control signal commanding the ON-state of the contacts. In contrast, the complementary symmetry, push-pull switching transistor configuration operates to couple the push-pull output node (node A) to ground potential in response to an OFF potential on the control node. The OFF potential on the control node corresponds either of the following states: (i) the control signal commanding the OFF-state of the contacts, and (ii) the loss of operating potential across Vcc to ground.

The switching circuit may be implemented using any number of transistor technologies, such as using MOSFETs, JFETs, BJTs, etc. By way of example, a pair of n-channel MOSFETs and a p-channel MOSFET are used to implement the switching circuit. The operation of the specific transistor implementation is as follows. Referring also to FIG. 2, at times just prior to t4, the potential on the GPIO pin is assumed to be either in the OFF state or FLOAT state. In either case, there is assumed to be no charge on the capacitance 162, and the contacts of the relay 14 are assumed to be latched OFF (with no power delivered to the AC LOAD).

At time t4, the voltage potential on the GPIO pin increases to the ON state (e.g., about 1 volt), which is applied across a shunt resistor Rs and across the gate-to-source of a gate control n-channel MOSFET, M1. In response, transistor M1 turns ON and conducts current from drain-to-source thereof, thereby pulling the gates of a source p-channel MOSFET, M2 and a sink n-channel MOSFET, M3 to ground potential. In response to such gate potential, the source transistor M2 turns ON and the sink transistor M3 turns OFF. This switching condition of the complementary transistors M2, M3 results in the Vcc potential being coupled to the coil current output node A and sourcing current through the coil in the first direction. The sourced current flows back into the other coil current output node B and through the capacitance 162 (which is initially discharged) to ground potential. Thus, the ON-pulse of current has a sharp rise-time up to +X mA, but then slowly decays as the charge builds up on the capacitance 162. When the potential across the capacitance reaches Vcc, the magnitude of the ON-pulse is zero mA (just prior to t5).

At time t5, the voltage potential on the GPIO pin may either be intentionally driven to the OFF state (e.g., 0 volts), or in the case of a loss of operating power, the GPIO pin may attain a FLOAT state. In either scenario, any charge stored in the gate-to-source capacitance of the transistor M1 is swept away by: (i) the shunt resistor Rs (in the case of a FLOAT state), or (ii) by both the resistor Rs and the sinking of current into the GPIO pin (in the case of an OFF state). In response, transistor M1 turns OFF and any conduction of current from drain-to-source thereof is eliminated. The voltage potential on gates of the p-channel MOSFET, M2 and the n-channel MOSFET, M3 is permitted therefore to increase through a bias current flowing from Vcc through bias resistor Rb. Notably, even as Vcc begins to droop in the case of a loss of operating power, the voltage on the gates of transistors M2, M3 will increase for some limited duration of time. During that time, source transistor M2 will turn OFF and sink transistor M3 will turn ON. This switching condition of the complementary transistors M2, M3 results in the ground potential being coupled to the coil current output node A and sinking current from the coil in the second direction. The current flows from the capacitance 162 (which is initially fully charged) into the coil current output node B, through the coil, into the coil current output node A, through transistor M3 (drain to source) to ground potential. Thus, the OFF-pulse of current has a sharp fall-time down to −X mA, but then slowly rises as the charge dissipates from the capacitance 162. When the potential across the capacitance reaches zero, the magnitude of the OFF-pulse is zero mA.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. An apparatus, comprising:

at least one electromechanical, latching relay including a coil and at least one pair of contacts, the contacts transitioning from: (i) an OFF, disconnected state to an ON, connected state in response to an ON-pulse of current through the coil in a first direction; and (ii) the ON state to the OFF state in response to an OFF-pulse of current through the coil in a second, opposite direction;

a driver circuit having at least one control signal input node, at least one pair of coil current output nodes, and at least one pair of operating power nodes, wherein the driver circuit operates to:

(i) produce the ON-pulse of current between the at least one pair of coil current output nodes and through the coil of the relay in response to a control signal commanding the ON-state of the contacts;

(ii) produce the OFF-pulse of current between the at least one pair of coil current output nodes and through the coil of the relay in response to a control signal commanding the OFF-state of the contacts; and (iii) produce the OFF-pulse of current between the at least one pair of coil current output nodes and through the coil of the relay in response to a loss of operating potential across the pair of operating power nodes; and a microcontroller having at least one output operating to produce the control signal, such that the control signal is at an ON-potential when commanding the ON-state of the contacts, and at a differing OFF-potential when commanding the OFF-state of the contacts.

2. The apparatus of claim 1, wherein the ON-potential is one of a logic high level and a logic low level, and the OFF-potential is the other of the logic high level and the logic low level.

3. The apparatus of claim 1, wherein:

the at least one output of the microcontroller is a tri-state output, which exhibits a high impedance, FLOAT-potential at least during a loss of operating potential; and the driver circuit operates to produce the OFF-pulse of current between the at least one pair of coil current output nodes and through the coil of the relay in response to the FLOAT-potential.

4. The apparatus of claim 1, wherein:

the driver circuit includes a capacitance for storing electrical charge; and the driver circuit operates to source a pulse of current from one of the operating power nodes through one of the coil current output nodes, through the coil of the relay in the first direction, and through the capacitance, thereby storing charge on the capacitance, in response to the control signal commanding the ON-state of the contacts.

5. The apparatus of claim 4, wherein the driver circuit operates to source a pulse of current from the capacitance by discharging the stored charge thereon, through the other of the coil current output nodes, through the coil of the relay in the second direction, and into the other of the operating power nodes, in response to: (i) the control signal commanding the OFF-state of the contacts, and (ii) the loss of operating potential across the pair of operating power nodes.

6. The apparatus of claim 5, wherein:

the capacitance includes at least one capacitor coupled between the other of the coil current output nodes and the other of the operating power nodes; and the driver circuit includes a switching circuit operating to couple the one of the operating power nodes to the one of the coil current output nodes, in response to the control signal commanding the ON-state of the contacts, thereby sourcing the pulse of current through the coil of the relay and through the capacitance in the first direction, and thereby storing the charge on the capacitance.

7. The apparatus of claim 6, wherein the switching circuit operates to couple the other of the operating power nodes to the one of the coil current output nodes, in response to: (i) the control signal commanding the OFF-state, and (ii) the lose of operating potential across the pair of operating power nodes, thereby sourcing the pulse of current from the capacitance, by discharging the stored charge thereon, through the coil of the relay in the second direction, and into the other of the operating power nodes.

8. The apparatus of claim 7, wherein:

the switching circuit includes a complementary symmetry, push-pull switching transistor configuration, including a control node and a push-pull output node; and the push-pull output node is coupled to the one of the coil current output nodes.

9. The apparatus of claim 8, wherein the complementary symmetry, push-pull switching transistor configuration operates to couple the push-pull output node to the one of the operating power nodes, in response to an ON potential on the control node corresponding to the control signal commanding the ON-state of the contacts.

10. The apparatus of claim 9, wherein the complementary symmetry, push-pull switching transistor configuration operates to couple the push-pull output node to the other of the operating power nodes, in response to an OFF potential on the control node corresponding to: (i) the control signal commanding the OFF-state of the contacts, and (ii) the loss of operating potential across the pair of operating power nodes.

11. The apparatus of claim 1, wherein the contacts of the relay are coupled between a source of power and a load.

12. A driver circuit for a latching relay having a coil and a pair of contacts, said pair of contacts being respectively coupled to an operating potential and a load, wherein said contacts are latched closed to connect said operating potential to said load in response to a current pulse in said coil of a first polarity, and are latched open in response to a current pulse in said coil of a second polarity opposite to the first polarity to disconnect said operating potential from said load, wherein said latching relay does not require any holding current to maintain said contacts in either the closed or open states, said driver circuit being configured to produce a current pulse of said second polarity in said coil to latch the relay contacts in an open state upon loss of said operating potential.

* * * * *